United States Patent [19]

McGourty et al.

[11] Patent Number: 4,683,820

[45] Date of Patent: Aug. 4, 1987

[54] PRINTING MECHANISM

[75] Inventors: Thomas K. McGourty; Lawrence F. McGourty, both of Pas Robles, Calif.

[73] Assignee: Varitronic Systems, Inc., Eden Prairie, Minn.

[21] Appl. No.: 809,792

[22] Filed: Dec. 6, 1985

Related U.S. Application Data

[62] Division of Ser. No. 608,050, Feb. 17, 1984, Pat. No. 4,579,056.

[51] Int. Cl.[4] ..... B41J 9/28

[52] U.S. Cl. ..... 101/93.36; 101/93.48; 400/157.1

[58] Field of Search ..... 101/93.35, 93.48, 93.03, 101/93.16, 93.28, 93.29, 93.30, 93.31, 93.32, 93.33, 93.34, 93.36, 93.41, 316, 18, 292, 298; 400/157.1, 157.2, 157.3, 158, 134

[56] References Cited

U.S. PATENT DOCUMENTS

| | | | |
|---|---|---|---|
| 3,556,002 | 1/1971 | Bragg | 101/93.48 |
| 4,243,333 | 1/1981 | Bradshaw et al. | 400/613 X |
| 4,557,192 | 12/1985 | Dollenmayer | 101/93.48 |

*Primary Examiner*—Charles A. Pearson

*Attorney, Agent, or Firm*—Merchant, Gould, Smith, Edell, Welter & Schmidt

[57] ABSTRACT

A printing mechanism for use in an impact printing system primarily intended for the transfer of a dry film impression onto an image carrying tape. The mechanism includes a hammer (130), and an anvil (126). The hammer is actuated by lever arm (164) which is in turn accuated by eccentric cam (194). At its upper end the hammer is biased by a pivotal spring mechanism (152) against a roller bearing (162). At its lower end the hammer (130) has a guide pin (140) which passes through an aperture (144) in a guide plate (142). The guide plate is adjustably mounted by means of slots (141) so that movement of the guide plate adjusts the inclination of the hammer.

1 Claim, 9 Drawing Figures

PRINTING MECHANISM

This is a division of application Ser. No. 608,050, filed Feb. 17, 1984, now U.S. Pat. No. 4,579,056.

TECHNICAL FIELD

This invention relates generally to printing or typing equipment involving the use of a pressure process to transfer dry film impressions onto an image carrying tape. Specifically, this invention is directed to the impact printing mechanism which transfers the image.

CROSS REFERENCE

This application hereby incorporates by reference the disclosures of our co-pending applications filed on even date herewith with the following titles:

Precision Tape Feed and Guide Mechanism, Ser. No. 587,184

Print Disk Positioning System, Ser. No. 584,454

Ribbon Cassette, Ser. No. 592,018

Tape Cassette with Supply Indicator, Ser. No. 598,554

Electronic Tape Writing Machine, Ser. No. 587,318

BACKGROUND OF THE INVENTION

In the field of commercial art, there is a significant need for the simple means of transferring prefabricated letters or characters to a "paste-up" sheet for later photographing and printing. A dry rub-on transfer letter process is well known. However, these materials are supplied in sheets and must be carefully aligned to produce acceptable images. Machines were later developed which prepared such letters on a continuous tape which solved many of the alignment problems. An example of such machine is shown in PCT Publication WO82/03600 and in U.S. Pat. No. 3,912,064, as well as U.S. Pat. No. 4,243,333.

Since the transfer of characters may be used in enlargement and high resolution printing, the imprint must be extremely accurate. As the transfer media is often a carbon film impressed onto a paper tape having low adhesion, high force must be applied to make a proper impression and a striking position of the hammer and anvil in the printing mechanism must be extremely well aligned. In addition, all of this activity must take place in a very short time period if the machine is to be capable of high speed printing.

The present invention overcomes the problems noted above inherent in the prior art while providing a mechanism capable of rapid generation of characters with an extremely high degree of quality and consistency.

SUMMARY OF THE INVENTION

The invention is generally directed to an impact printing apparatus to transfer an impression of a character from a print disk onto an image carrying tape with a color carrying film, including a press having first and second members relatively closeable toward each other to apply pressure when the print disk, tape and film are positioned therein, the first member being fixed in position and having a first planar surface and the second member having a second planar surface opposite the first surface and being movable substantially along a path orthogonal to the first surface. The apparatus also includes a drive member having two ends propelling the second planar surface toward the first surface, the drive member slideably engaging the second member at one end and having a pivot between its ends, and lever means for moving the other end of the drive member to rotate on the pivot causing one end to move in a direction opposite of the movement and thereby drive the planar surfaces together, the pivot being eccentric and rotatable about an axis, the rotation thereof having the effect of moving the location of the pivot thereby changing the rotational movement of the lever means.

According to another aspect of the invention, the second member includes a hammer having upper and lower surfaces, the upper surface having the planar surface and wherein the drive member is mounted on a rotatable eccentric shaft. According to a further aspect of the invention, the lower portion of the hammer is narrower than the upper portion and when the drive member includes a pair of space members with a slot there between which receives the narrower portion of the hammer and is aligned to engage the upper portion of the hammer when the drive member is actuated.

According to a further aspect of the invention, the lower portion of the hammer includes a guide member which allows for alignment of the location of the planar surface thereon.

Various advantages and features of novelty which characterize the invention are pointed at with particularity in the claims annexed hereto and forming a part hereof. However, for a better understanding of the invention, its advantages and objects obtained by its use, reference should be had to the drawings which form a further part hereof, and to the accompanying descriptive matter in which there are illustrated and described certain preferred embodiments of the invention.

BRIEF DESCRIPTION OF THE DRAWINGS

In the drawings, wherein like reference numerals refer to like elements throughout the several views.

DETAILED DESCRIPTION OF THE PREFERRED EMBODIMENTS

Figure 1:
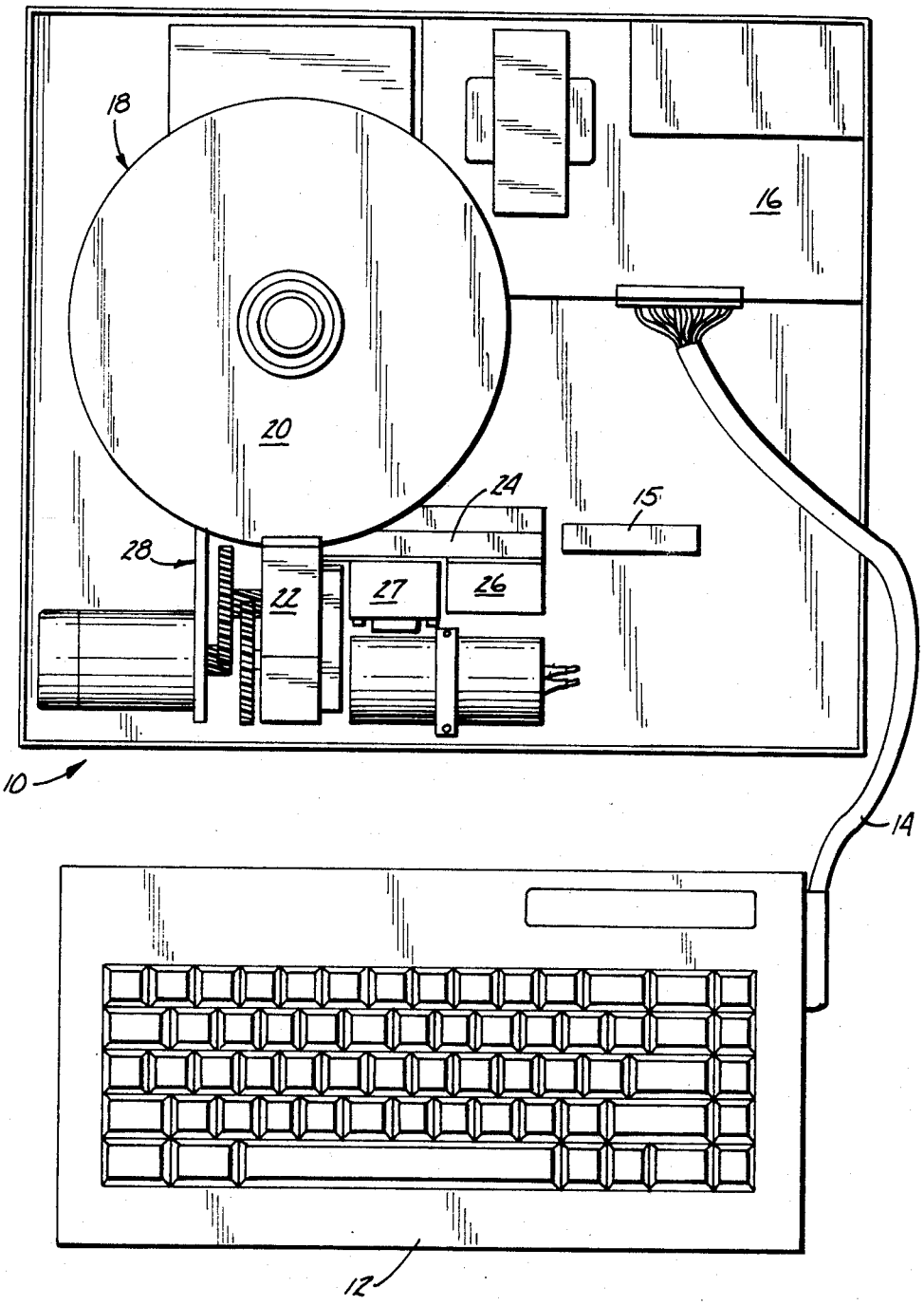
FIG. 1 is an overall plan view of a preferred embodiment of the invention in a working environment.

To understand a possible implementation of the present invention in a larger printing system, reference should be had to FIG. 1 which shows an overall environmental view of the system in which the invention is preferably employed. FIG. 1 shows an electronic tape writing machine 10 having a keyboard 12 which is connected by a cable 14 to an electronics section 16. Signals from the keyboard are interpreted by the electronics section 16 which cause the print disc positioner 18 to locate the print disc 20 in an appropriate position within the jaws of the impact printing device 22, which holds a carrier tape 15 and a carbon like material 24. The material is advanced by tape advance device 27 and may later be cut by tape cutting device 28.

In this embodiment, print disk 20 would be positioned with the appropriate raised (or depressed) character in alignment with impact printing device 22. The printing action accomplished by device 22 is explained in detail hereinafter.

Device 22 is built within a structure formed of two mirror image housing halves 124 which have an anvil plate 126 affixed thereto in the disk slot 128. Alternately, three pieces, two sidewalls and a center portion, may be used.

Figure 3:
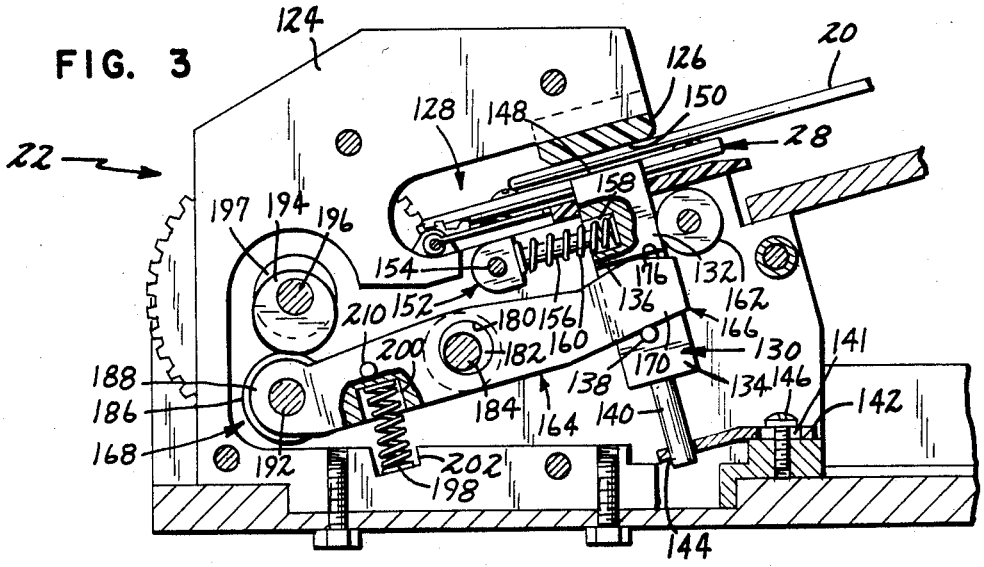
FIG. 3 is a view taken along lines 3—3 of FIG. 2.

Looking to FIG. 3, the printing device has a disk receiving slot 128 into which disk 20 is received. On the lower periphery of the disk slot (and it is understood that the upper and lower positions may be reversed) there is located hammer 130 which is intended to strike toward the anvil 150 causing disk 20, paper 15 and film 24 to be brought into contact.

Figure 2:
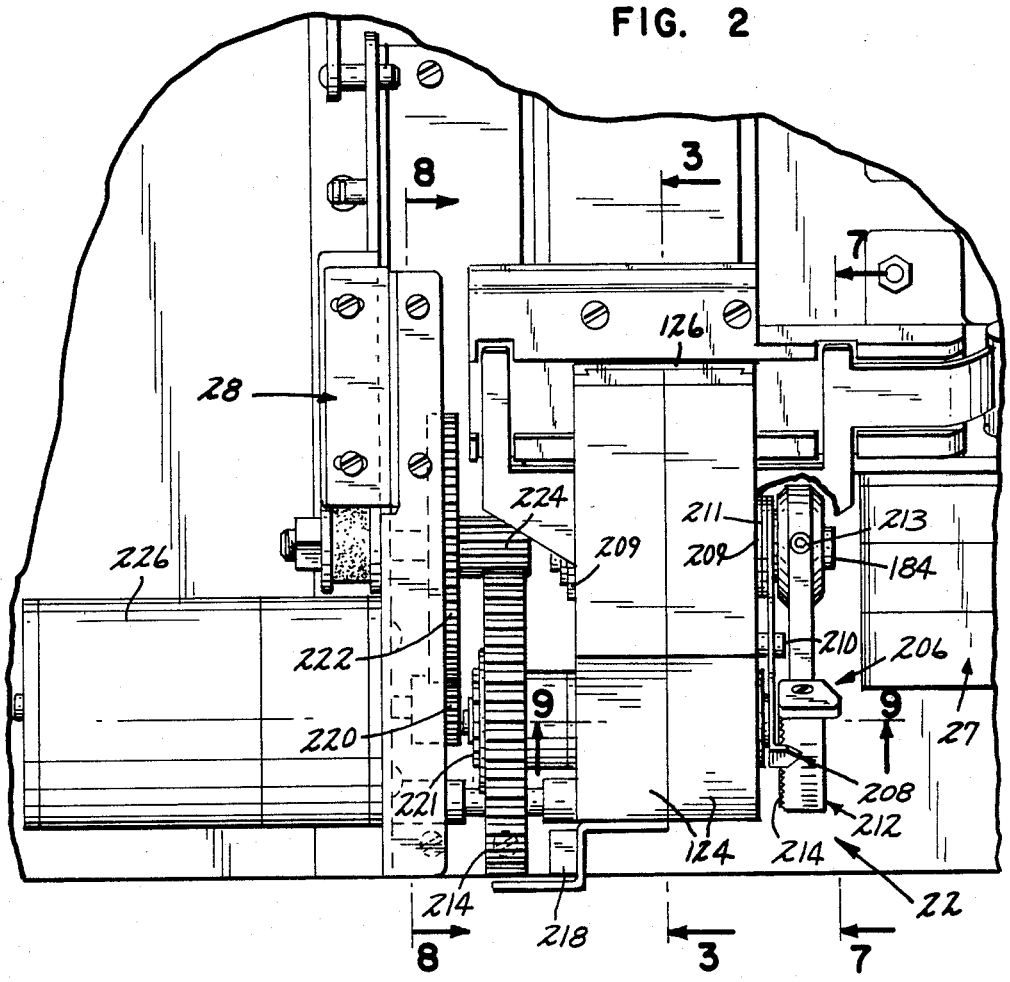
FIG. 2 is a top plan view of a portion of the preferred embodiment.
Figures 4, 5, 6:
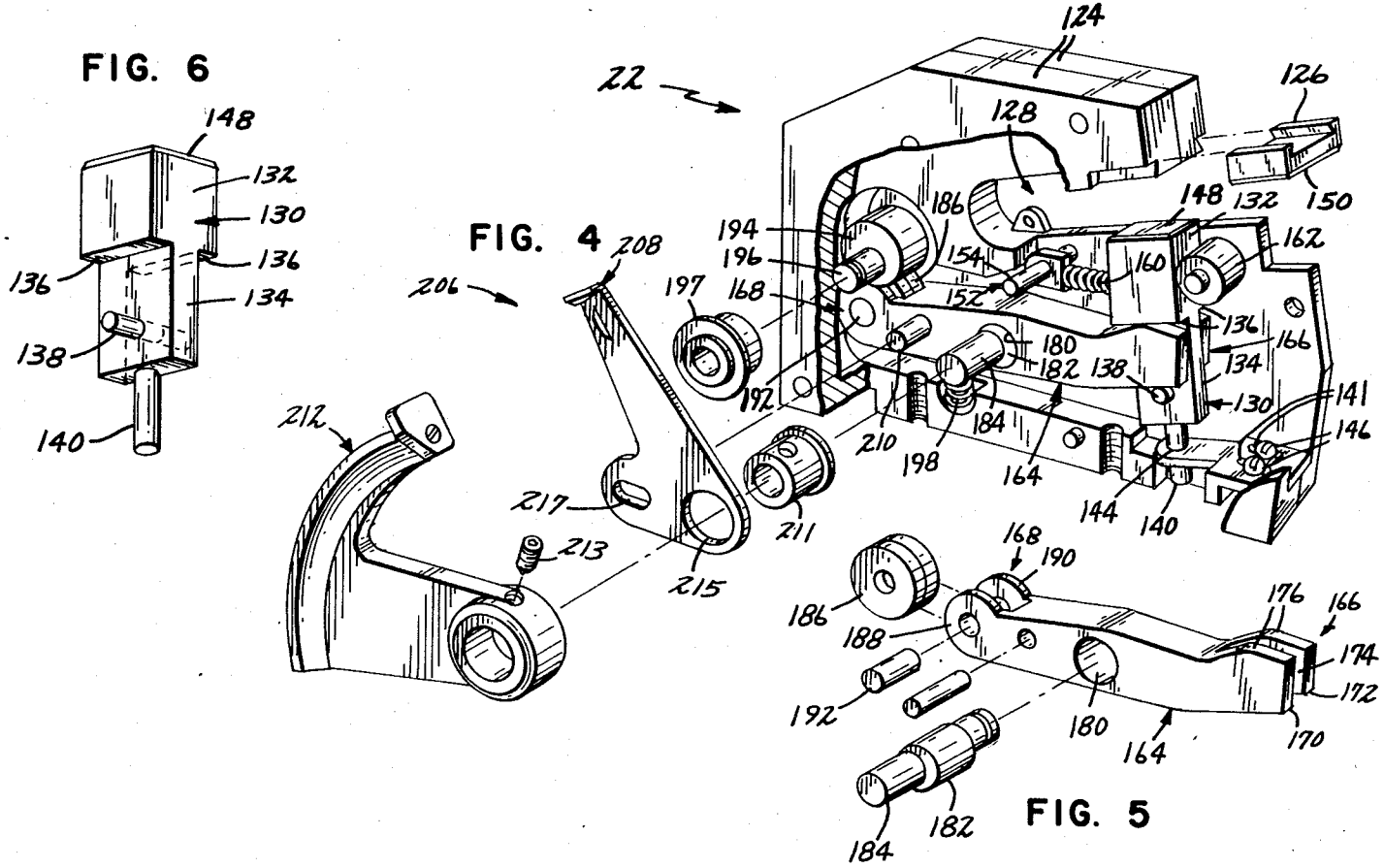
FIG. 4 is an exploded perspective view of a portion of the preferred embodiment.
FIG. 5 is an exploded perspective view of the print lever and associated components.
FIG. 6 is a perspective view of the print hammer of the preferred embodiment.

Hammer 130 is shown in greatest detail in FIGS. 2, 4 and 6 wherein it has an upper portion 132 and a lower portion 134. At their junction, there is defined shoulders 136 whose purpose will be explained hereinafter. A predetermined distance from the shoulders is a stop pin 138 which extends through lower portion 134. From the bottom of 134 extends the guide pin 140.

Turning to FIGS. 3 and 5, it can be seen that hammer 130 is supported at its bottom end by having guide pin 140 pass through guide plate 142 through aperture 144. Guide plate 142 is affixed by fasteners 146. Elongated apertures 141 are provided through guide plate 142 to permit the plate to be moved in all directions within a horizontal plane which, in turn, moves pin 140 and thus aligns hammer 130 and its planar striking surface 148 with a like striking surface 150 on anvil plate 126.

At the upper end, hammer 130 is supported by a pivotal spring mechanism 152 which includes a pivot pin 154 and a stem 156 around which a spring 160 is situated. The spring 160 and shaft 156 extend into a depression 158 in hammer 130. Spring 160 biases hammer 130 against a roller bearing 162 which is free to rotate as the hammer is moved along an axis generally orthogonal to the planar surface 150 of the anvil 126. It is an important objective of this invention to align surfaces 148 and 150 in parallel and to provide a high impact force while maintaining this parallel arrangement. This provides for a high quality transfer impression and no damage or wear to disk 20.

Hammer 130 is actuated, (i.e. caused to travel upward or downward) by the drive lever 164 shown also in FIG. 5. Lever 164 includes an end at 166 and another end at 168. At end 166, the lever is formed in the shape of parallel spaced apart blades 170 and 172 which form a saddle and define a slot 174 there between. The width of the slot is sized to receive lower portion 134 of the hammer 130. Blades 170 and 172 include contact surfaces 176 which abut shoulders 136 on hammer 130. Between ends 166 and 168 there is located an aperture 180 in lever 164. Aperature 180 receives an eccentric member 182 having a shaft 184. Shaft 184 is journeled in bearings 209 (see FIG. 2) in housing halves 124 and extends through the housing halves 124 for attachment to an adjustment device 212. When shaft 184 turns, eccentric bearing 182 is also rotated. This effectively moves the pivot point of drive lever 164 to a new position, which changes the stroke or travel of the arm when actuated. Actuation is accomplished by applying pressure to end 168 preferably against a roller bearing 186 which is held between blades 188 and 190 by pin 192.

The actuation of drive lever 164 is accomplished by an eccentric cam 194 turned by a motor driven shaft 196 which itself is supported on bearings 197. To maintain drive lever 164 biased against cam 194, a spring 198 is provided which seats within a depression 200 in the lower side of the lever on 164 and a like depression 202 (shown in FIG. 3) in the base of the housing halves 124.

Figure 7:
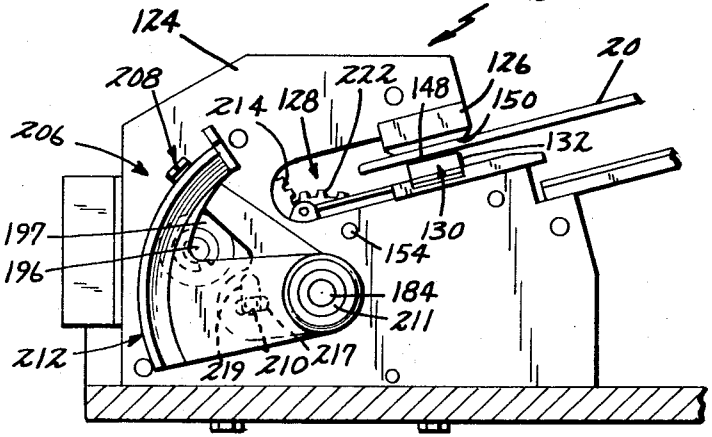
FIG. 7 is a view taken along lines 7—7 of FIG. 2.
Figure 9:
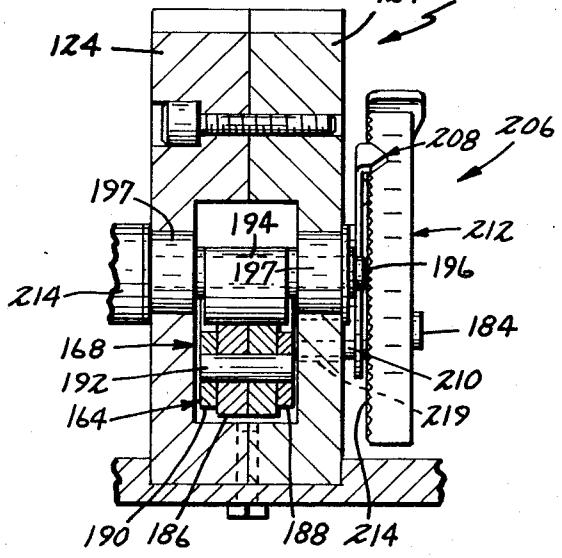
FIG. 9 is a view taken along lines 9—9 of FIG. 8.

Shaft 184 on eccentric pin 182 is attached to an indicator device 206 shown in FIGS. 4, 7 and 9. This device includes an indicator 208 which is fixed by means of a pin 210 rigidly extending from lever 164 through a slot 219 in one housing half 124, through a slot 217 in indicator 208, and a semicircular adjuster member 212. Indicators 208 and calibrated adjuster 212 are biased against each other and serrations 214 in adjuster 212 prevent unanticipated movement thereof by means of friction. Shaft 184 is supported within bushing 211 which in turn supports indicator 208 and adjuster 212. A set screw 213 affixes adjuster 212 to shaft 184. Bushing 211 passes unimpeded through aperture 215 in indicator 208. Indicator 208 includes the elongated slot 217 for receiving pin 210. The elongation of slots 217, 219 allows for the reciprocal movement of the lever 164 (See FIG. 7).

Thus, it can be seen that the printing mechanism can be adjusted in two ways. First, with respect to the contact of surfaces 148 and 150 such that they are held as parallel as possible. This is accomplished by means of moving guide plate 142. The second adjustment is with respect to travel of the hammer which is controlled by the device 206 by means of eccentric bearing 182.

Figure 8:
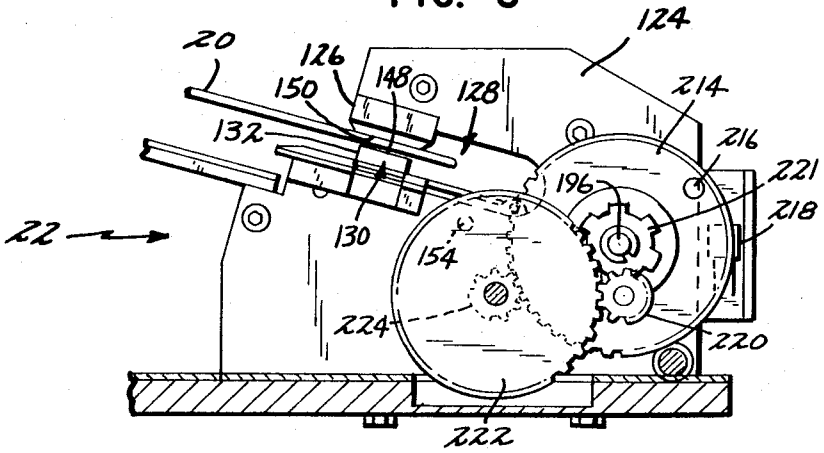
FIG. 8 is a view taken along lines 8—8 of FIG. 2.

In order to ensure that the hammer and anvil start at their most open positions between impacts, a sensor is provided to stop the motor driving cam 194 in the appropriate position. FIG. 8 illustrates a gear 214 which is attached to shaft 196 by means of a conventional slip clutch arrangement 221. At an appropriate location on the gear is a magnet 216. Affixed to the back edge of the press is a Hall effect sensor 218, which in the preferred embodiment is a semi conductor which is capable of sensing a magnetic field. The sensor 218 changes state when in the presence of a magnetic field, and this change can be easily converted to an on/off pulse for the motor as known in the art. Gear 214 is in turn driven by gears 220, 222 and 224 which are driven by motor 226 (see FIG. 2).

Although some specific embodiments of the present invention have been shown, those skilled in the art will perceive modifications which can be made without parting from the spirit of the invention. Therefore, it is intended that the scope of the present invention be dictated by the appended claims rather than by the description of the embodiment.

We claim:

1. An impact printing apparatus to transfer an impression of a character from a print disk to an image carrying tape with a color carrying film including a housing and a press having a first and second members relatively closeable toward each other, the members each having a planar surface which are brought toward each other during printing, said first member being rigidly affixed to said housing, said second member including a hammer having upper and lower ends and a drive lever, said planar surface of said second member being on said upper end of said hammer, said hammer having its planar surface generally parallel with the other planar surface and having four sides generally orthogonal to said planar surface, and said hammer being adjustably maintained in this position by fixed guide means adjacent said upper end and adjustable guide means affixed to said first member and engaging said hammer adjacent its lower end and, said lower end being slideably received within said adjustable guide means, said adjustable guide means including a plate with at least one slotted aperture therein and wherein said fixed guide means includes a roller affixed to said housing with its outer surface in contact with said hamamer adjacent said upper end so that movement of said adjustable guide means will cause pivotal movement of said hammer at said fixed guide means and permit alignment of said planar surfaces.

* * * * *